US009955782B2

(12) United States Patent
Rue et al.

(10) Patent No.: US 9,955,782 B2
(45) Date of Patent: May 1, 2018

(54) ART PANEL RACK

(71) Applicants: James S Rue, Banner Elk, NC (US); Carolyn A Crocker Rue, Banner Elk, NC (US)

(72) Inventors: James S Rue, Banner Elk, NC (US); Carolyn A Crocker Rue, Banner Elk, NC (US)

( * ) Notice: Subject to any disclaimer, the term of this patent is extended or adjusted under 35 U.S.C. 154(b) by 0 days. days.

(21) Appl. No.: 15/088,351

(22) Filed: Apr. 1, 2016

(65) Prior Publication Data

US 2017/0280870 A1 Oct. 5, 2017

(51) Int. Cl.

| | |
|---|---|
| ***A47G 19/08*** | (2006.01) |
| ***A47H 1/00*** | (2006.01) |
| ***A47F 5/08*** | (2006.01) |
| ***A47B 43/00*** | (2006.01) |
| ***A47B 47/00*** | (2006.01) |
| ***A47B 57/00*** | (2006.01) |
| ***A47B 81/00*** | (2006.01) |
| ***B44D 3/00*** | (2006.01) |
| ***A47F 5/10*** | (2006.01) |
| ***A47F 7/00*** | (2006.01) |

(52) U.S. Cl.

CPC ..... *A47B 81/00* (2013.01); *A47B 43/00* (2013.01); *A47B 47/00* (2013.01); *A47F 5/10* (2013.01); *A47F 7/0042* (2013.01); *B44D 3/00* (2013.01)

(58) Field of Classification Search

CPC ..... A47B 81/00; A47B 47/00; A47B 43/00; A47B 45/00; B44D 3/00; A47G 25/0685; D06F 57/08; G09F 15/0068; A47F 3/004; A47F 5/10; A47F 7/0042; A47F 7/0021; A47F 5/0006; B65D 85/48

USPC ..... 211/41.1, 41.14, 41.15, 50, 100, 96, 211/87.01, 184, 195, 197, 149, 198, 175, 211/193, 41.6, 41.11, 85.5, 85.9; 248/447.2, 448, 454–457, 460–465

See application file for complete search history.

(56) References Cited

U.S. PATENT DOCUMENTS

| | | | | | |
|---|---|---|---|---|---|
| 53,705 | A * | 4/1866 | Trask | D06F 57/08 | 211/198 |
| 743,048 | A * | 11/1903 | Suffern | A47B 23/042 | 248/455 |
| 886,116 | A * | 4/1908 | Ouster | A47G 25/743 | 211/113 |
| 924,133 | A * | 6/1909 | Blake | A47G 23/06 | 248/465 |
| 956,399 | A * | 4/1910 | Morse | A47F 5/13 | 211/85 |
| 1,050,273 | A | 1/1913 | Handy | | |
| 1,104,004 | A * | 7/1914 | Rathbone | A24F 9/14 | 131/257 |

(Continued)

*Primary Examiner* — Jennifer E. Novosad
(74) *Attorney, Agent, or Firm* — Robert G. Rosenthal; Daniel Becker

(57) ABSTRACT

A rack for storing panels, and especially useful for drying of painted or gessoed panels, that is alternately configurable into different modes such that it can be inclined, laid flat, arranged vertically, or freestanding in the manner of an A-frame. Several best modes select dimensions that allow for components to be of similar and conveniently manufacturable dimensions and quantities of parts, to minimize costs and retain components in different positions depending upon their function during any of the alternate modes.

6 Claims, 8 Drawing Sheets

(56) References Cited

U.S. PATENT DOCUMENTS 1,266,245 A * 5/1918 Fuhrmann ..... A47J 47/16 211/41.11
1,301,145 A 4/1919 Mclaughlin
1,348,792 A * 8/1920 Feingold ..... A47L 19/00 211/41.4
1,518,216 A * 12/1924 Onody ..... A47L 19/00 211/41.11
1,968,644 A 7/1934 Absalom
1,981,268 A 11/1934 Heiser
2,122,770 A 12/1936 Colin
2,143,368 A * 1/1939 Binder ..... A47F 7/163 248/464
2,350,129 A 5/1944 Richards
2,376,063 A * 5/1945 Klick ..... A47B 97/08 248/464
2,588,529 A * 3/1952 Hume ..... B65H 49/16 211/85.5
2,896,830 A 7/1959 Bair
2,902,239 A * 9/1959 Janecka, Jr. ..... G09F 15/0062 248/165
3,058,706 A * 10/1962 Snell ..... A01G 5/04 248/220.41
3,095,666 A * 7/1963 Killen ..... A47B 97/08 248/449
3,164,256 A * 1/1965 Bennett ..... A47F 7/0028 211/189
3,304,045 A * 2/1967 Bethoney ..... A47B 97/08 248/170
3,715,097 A * 2/1973 Kalajian ..... A47B 97/04 248/449
4,109,892 A * 8/1978 Hartung ..... A47B 97/04 248/449
D251,647 S * 4/1979 Valien ..... D6/311
4,270,426 A * 6/1981 Raphael ..... B23Q 1/4866 269/57
D292,457 S * 10/1987 Hunter ..... D6/682.2
4,739,888 A * 4/1988 Steiner ..... D06F 57/12 211/119.01
4,778,064 A * 10/1988 Gold ..... B65G 49/062 206/456
4,779,914 A * 10/1988 Friedline ..... A47F 7/0028 211/198
4,807,766 A 2/1989 Compagnucci
5,086,872 A 2/1992 Lin
D334,309 S * 3/1993 Stricker ..... D6/674
5,287,946 A 2/1994 Mayo
5,590,435 A * 1/1997 Kostigian ..... A47F 7/17 15/268
5,931,320 A * 8/1999 Gajda ..... A47B 81/00 211/1.3
D417,536 S * 12/1999 Sum ..... D32/58
6,039,228 A * 3/2000 Stein ..... B60R 9/06 211/193
6,170,672 B1 * 1/2001 Boettcher ..... A47B 81/007 211/13.1
6,267,345 B1 * 7/2001 Turner ..... A47B 97/04 248/129
6,393,748 B1 * 5/2002 Cooper ..... G09F 7/18 248/165
6,669,213 B2 * 12/2003 Woerner ..... B62B 3/002 280/47.35
6,866,117 B2 3/2005 Moss
7,264,126 B1 * 9/2007 Bergeron ..... B65D 85/46 206/454
7,533,777 B2 5/2009 Winkler
7,735,661 B1 * 6/2010 Sumner ..... A47L 19/04 211/41.3
7,789,251 B1 9/2010 Clark
8,066,267 B2 * 11/2011 Schaerer ..... B05B 13/0285 248/130
8,453,852 B2 * 6/2013 Raddatz ..... D06F 57/12 211/104
8,615,924 B2 12/2013 Dinihanian, Jr.
8,844,737 B2 * 9/2014 Bukowski ..... D06F 57/12 211/100
2007/0012638 A1 * 1/2007 Van Eijk ..... D06F 57/08 211/104
2011/0088971 A1 4/2011 Jaffe
2013/0256495 A1 * 10/2013 Jewett ..... A47B 97/04 248/453

* cited by examiner

ART PANEL RACK

FIELD OF THE INVENTION

This invention relates generally to the field of artists' materials and more specifically to a rack for drying artists' panels or canvases which have been gessoed, painted, or varnished.

BACKGROUND OF THE INVENTION

In the production of "easel art," artists may employ a variety of substrates upon which they paint such as wooden panels, artist board, panel board, canvas or linen mounted on stretchers or other materials (and for ease of discussion the foregoing will be collectively referred to as a "panel" or "panels"). The foregoing panels each require preparation in order for the paint (or other material) to be employed to create the work of art. For example, gesso is used to prepare panels to receive paint and artists, in order to be efficient, will often prepare multiple panels at one time. This leads to the problem of where to place all of these panels while drying occurs. In addition, artists will often paint more than one picture at a time leading to the problem of where to safely store these panels with work in progress or completed panels coated while varnish is drying.

Current practice is to place the "in process" panels around the studio in any available space such as the floor, countertops, easels, leaning against a wall or any other available location. It is self-evident that this is a less than optimal solution since the panels are exposed to damage, dust or destruction from any one of a number of causes.

It is therefore an object of the present invention to overcome the drawbacks and deficiencies of current methods of panel storage problems.

Another object of the present invention is to provide an apparatus for the safe and efficient storage of "in process" panels.

Yet another object of the present invention is to provide an apparatus for the safe and efficient storage of "in process" panels that is inexpensive.

Still another object of the present invention is to provide an apparatus for the safe and efficient storage of "in process" panels that is easy to use.

A still further object of the present invention is to provide an apparatus for the safe and efficient storage of "in process" panels that is easy to assemble disassemble, has a variety of configurations, and requires minimal storage space when not in use.

SUMMARY OF THE INVENTION

To accomplish the foregoing objects, there is provided . . . .

BRIEF DESCRIPTION OF THE DRAWINGS

Some of the features and advantages of the invention having been briefly described, others will appear from the detailed description which follows, when taken in connection with the accompanying drawings, in which—

BRIEF DESCRIPTION OF THE PREFERRED EMBODIMENTS

While the present invention will be described more fully hereinafter with reference to the accompanying drawings, in which particular embodiments are shown, it is to be understood at the outset that persons skilled in the art may modify the invention herein described while still achieving the favorable results of this invention. Accordingly, the description which follows is to be understood as a broad teaching disclosure direct to person of skill in the appropriate arts and not as limiting upon the present invention.

Figure 1:
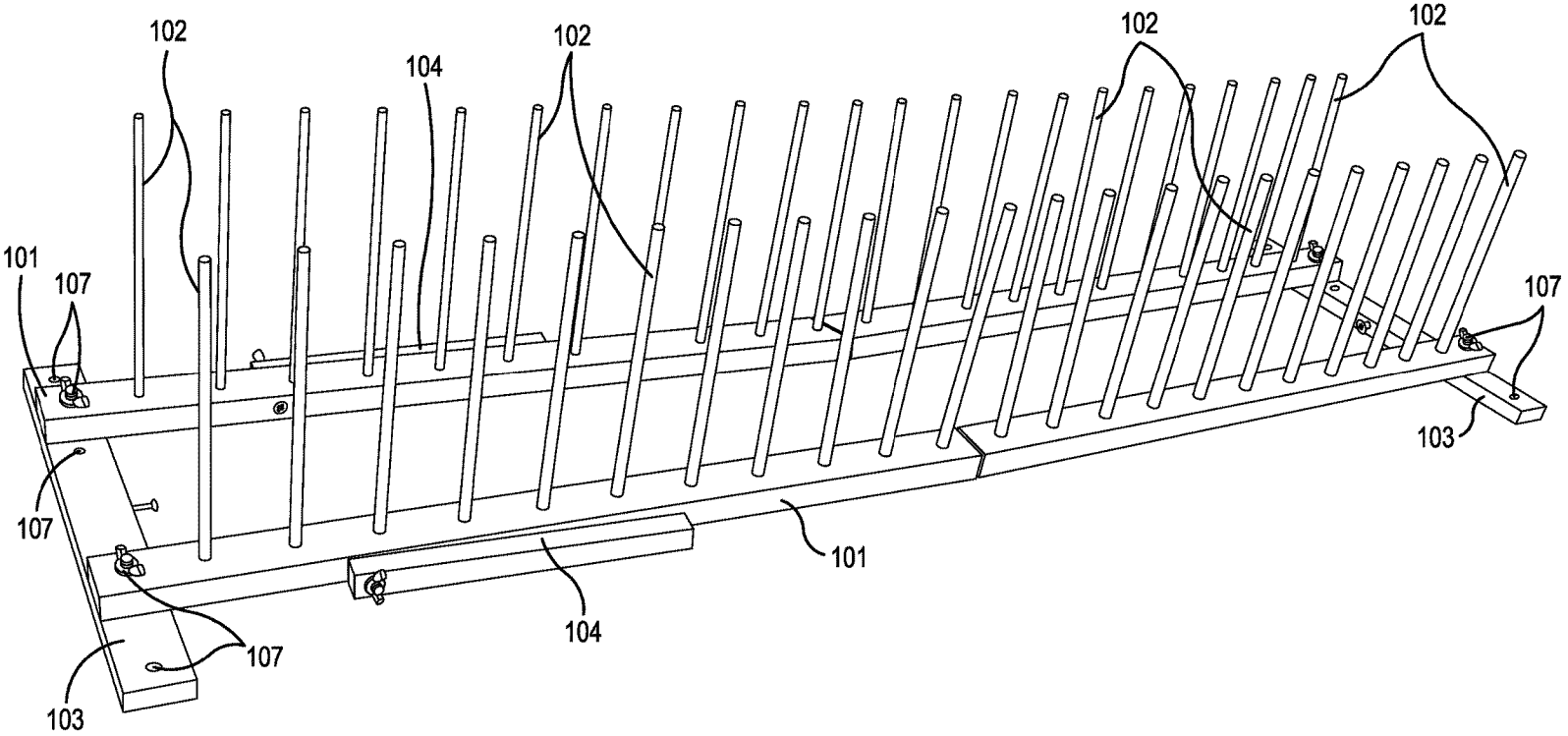
FIG. 1 is a perspective view of the linear embodiment of the panel drying rack in the flat position.

Referring now to the figures and particularly to FIG. 1, there is shown a panel drying rack laying flat on a horizontal support surface. A pair of matching elongate supports 101 extends horizontally. Sets of spindles 102 are arranged at intervals along the length of the elongate supports 101, and each set of spindles 102 extends in a direction that is substantially a large angle away from the direction of the length of the elongate supports 101. The sets of spindles 102 define panel spaces, spaces that are adapted to receive panels so that multiple panels can be supported by the rack at the same time and be separated from one another.

Adjacent the end of each elongate support, there is a spreader bar 103. The spreader bar 103 supports the elongate supports above the surface. Therefore, spreader bar 103 acts a foot. As shown, there is a spreader bar 103 at both ends of each elongate support 101 in this embodiment.

The spreader bar 103 also allows the elongate supports to connect with it at several positions along its length. Length of the spreader bar 103 extends laterally with respect to the elongate supports 101, the entire collection of positions in the lateral direction defining a range of lateral positions. As shown, the range includes preselected positions 107. Therefore, the spreader bar 103 is provides a range of lateral support positions as part of a rail mechanism. The spreader bars 103 maintain the elongate supports in spaced relation.

Figure 2:
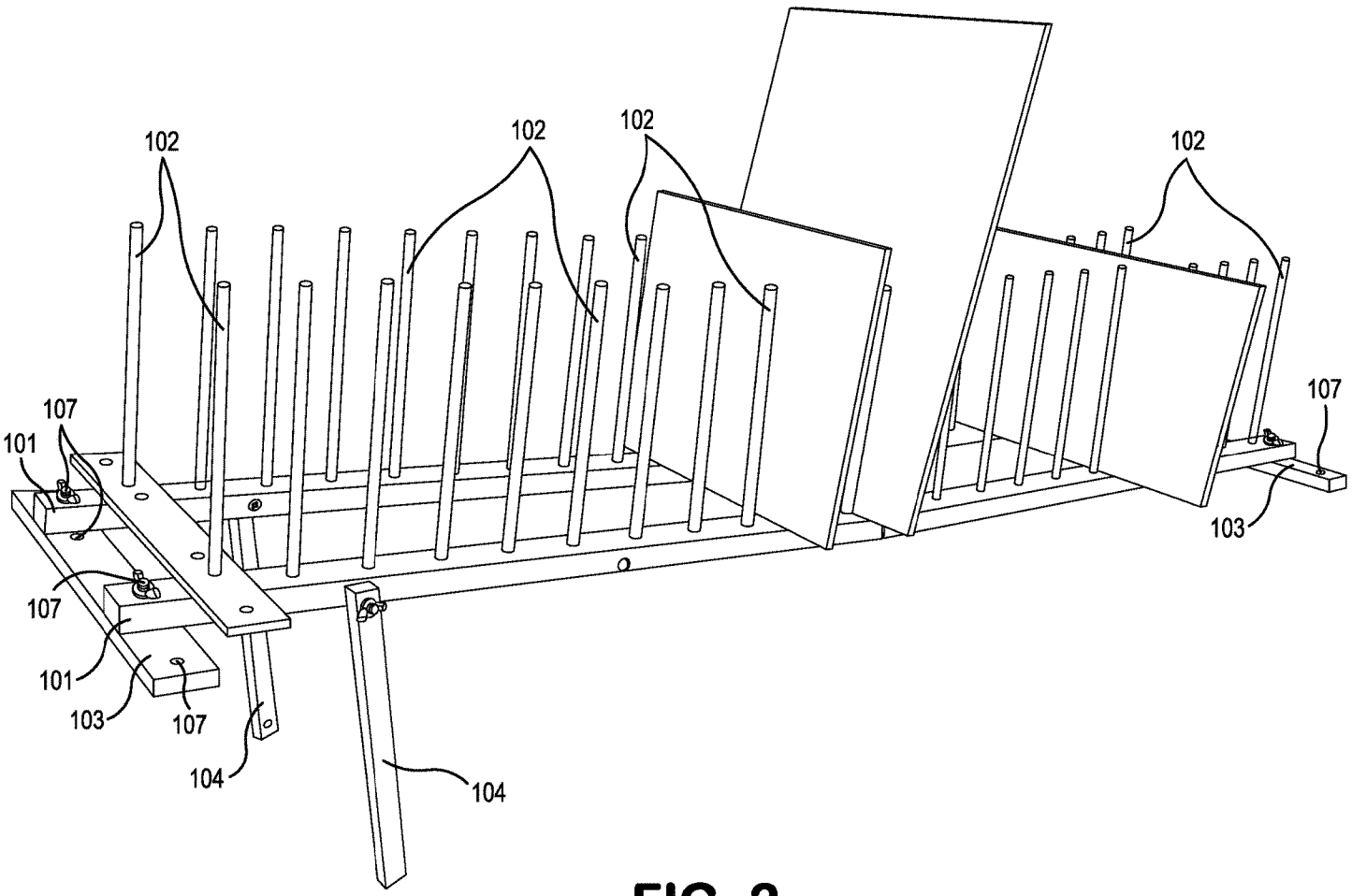
FIG. 2 is a perspective view of the linear embodiment of the panel drying rack in the elevated position.

Referring now to FIG. 2, an embodiment of the panel drying rack is shown in an elevated position. It is elevated by a prop mechanism that comprises at least one leg 104. Here, two such legs 104 are shown opposite one another and extend from the elongate supports 101, each leg 104 being proximate one of the ends of at least one elongate support 101, such that the end is in an elevated position. In both FIGS. 1 and 2, the panel spaces defined by the spindles 102 extend substantially upward.

Figure 3:
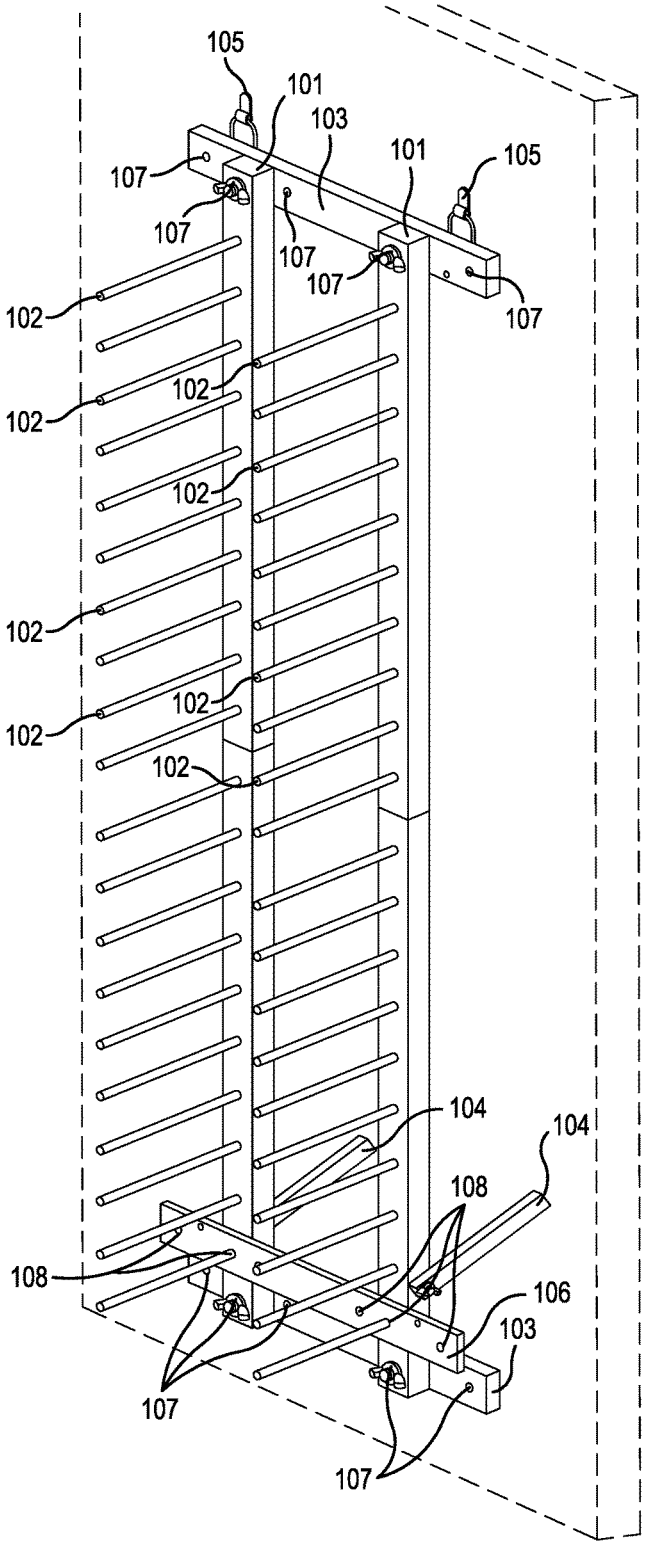
FIG. 3 is a perspective view of the linear embodiment of the panel drying rack mounted on a wall.

Referring now to FIG. 3, there is shown the panel drying rack mounted on a wall. A connector 105 is located proximate to the end of each elongate support 101 that is opposite the ends of the elongate supports 101 to which each leg 104 is proximate. The connectors 105 allow the system to maintain its linear configuration while mounted in a vertical direction to a wall. While the linear configurations of the system shown in FIGS. 1 and 2 arrange the elongate supports 101 at respectively zero and small angles with respect to the horizontal surface, with the panel spaces oriented substantially vertically, the linear configuration of the system shown in FIG. 3 is substantially vertical, a very high angle with respect to a horizontal surface. In FIG. 3, with the elongate supports 101 extending vertically, the sets of spindles 102 extend substantially horizontally, and therefore the panel spaces between the spindles 102 have a panel support plane, extending substantially horizontally, and can retain panels in a substantially horizontal orientation.

Figure 4:
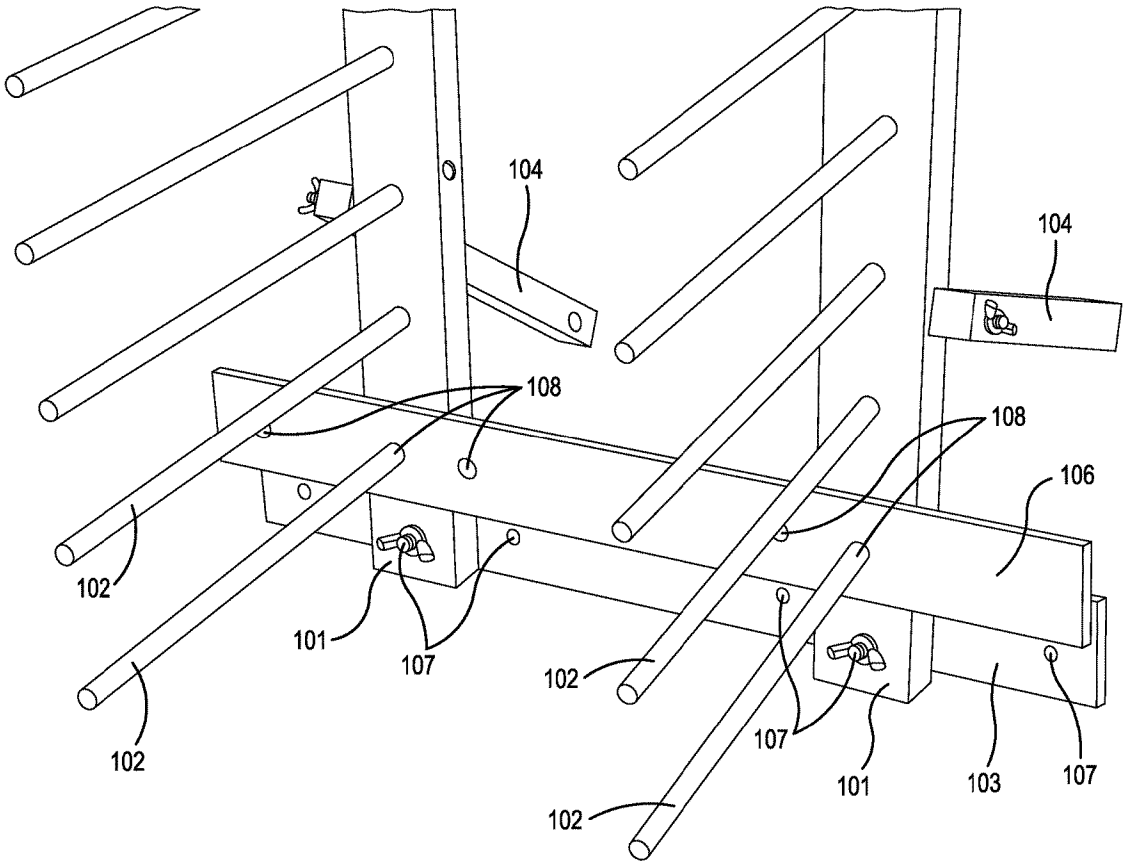
FIG. 4 is a perspective view of the lower end of the panel drying rack illustrating the legs extended to space the lower end of the rack away from the wall.

Referring now to FIG. 4, there is shown the lower end of the panel drying rack as mounted to a wall, but with each leg 104 extended, spacing the lower end of the system away from the wall. In this embodiment, the legs 104 form a prop mechanism that spaces. As in FIG. 2, each leg 104 plays the role of providing a space between a supporting surface and one end of the elongate rails 101. Here, mounted to a wall by hanging on the connectors 105, the panel spaces remain only at a small angle of inclination with respect to horizontal, and the panels near the ends of the elongate supports 101 are each proximate to a leg 104 are offset from the wall by the space provided by the legs forming a prop mechanism.

By contrast, when elevated from a horizontal surface by a leg 104 (as in FIG. 2), the elongate supports 101 are maintained at a small angle with respect to the floor, and the panels are instead retained at a high angle of inclination. Generally, panels are most efficient to dry when they are held in a substantially horizontal angle, thereby making mounting the system to a wall particularly good for drying panels. While less efficient for drying than vertical mounting, laying the elongate supports 101 horizontally, and thereby retaining panels vertically, still facilitates improved drying, because it provides spaces between adjacent panels.

Figure 5:
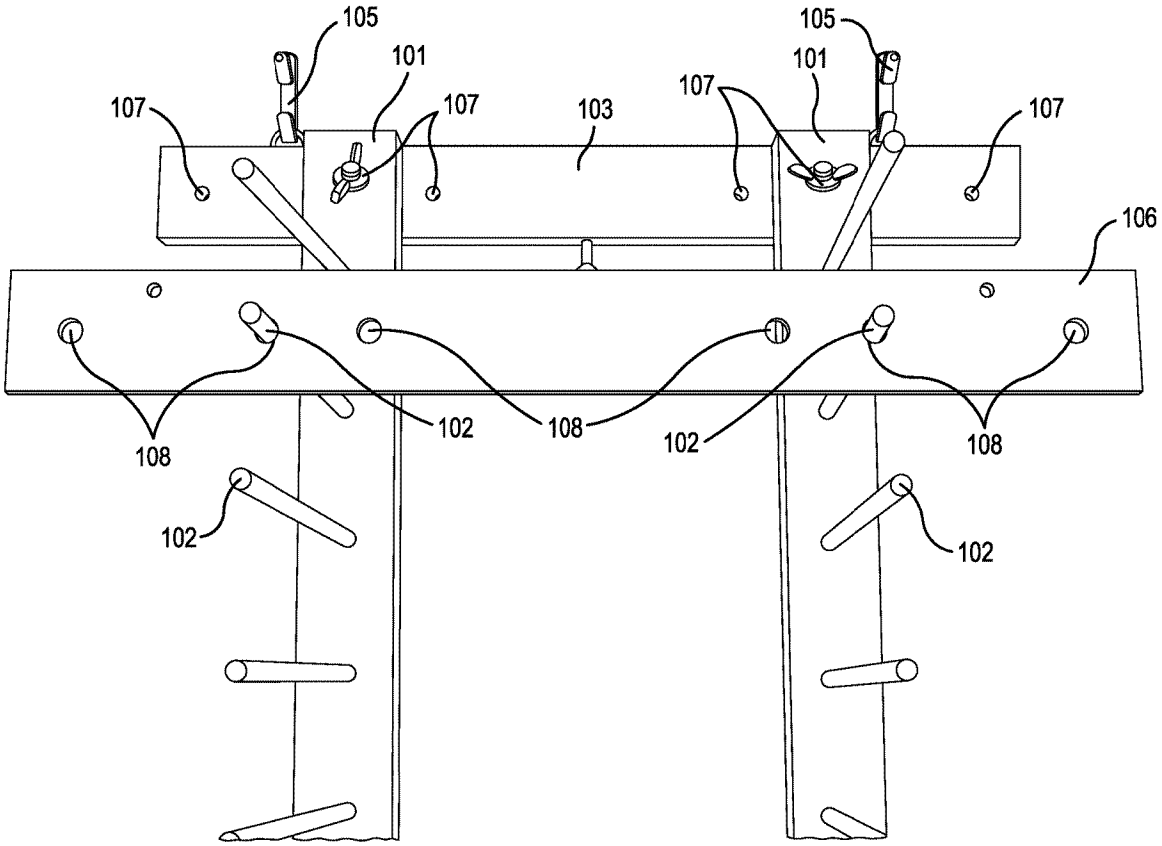
FIG. 5 is a plan view of the upper end of the panel drying rack illustrating the rack attached to the wall and the spacer bar.

Referring to FIG. 5, there is shown a front elevation view of the upper end of the system when it is mounted on a wall. The top ends of the elongate supports 101 connect with the spreader bar 103 at the ends which are each proximate to a connector 105, and extend downward therefrom in substantially offset relation as rails, similar to FIGS. 1 and 2. Also in view are the top few sets of spindles 102. The spreader bar 103 shown has several preselected lateral positions along its length, and the elongate supports 101 are each connected thereto at two of the preselected lateral positions. Disposed on a set of spindles 102 is a spacer bar 106.

The spacer bar 106 comprises several preselected positions 108 which are provided as a similar distance range to the lateral distance range over which the several preselected lateral positions 107 appear on the spreader bar 103. The similarity is such that the spacer bar can be located with respect to the the elongate supports 101 across a variety of distances at which the spindles 102 of a set of spindles 102 may be spaced, according to the elongate supports 101 being rails offset from one another in a rail mechanism.

Figure 6:
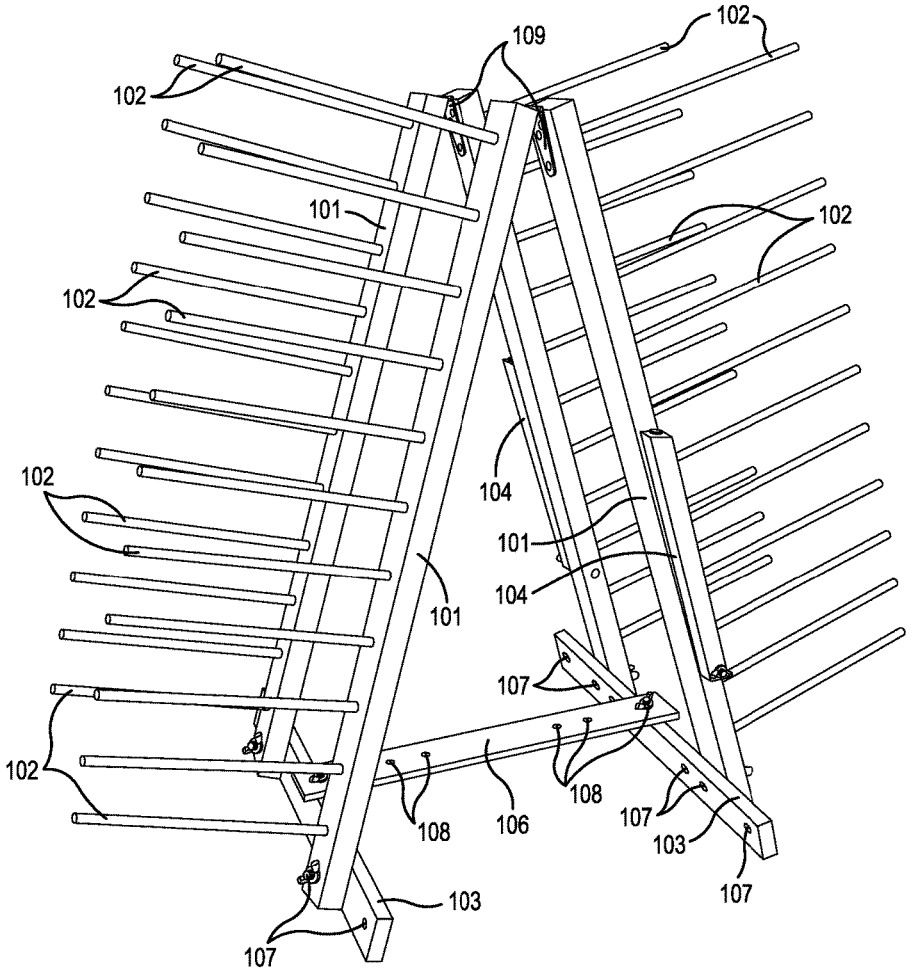
FIG. 6 is a perspective view of the panel drying rack in the triangular configuration resting upon a flat surface.

Referring to FIG. 6, what is shown is a panel drying rack in a triangular configuration resting upon a flat surface. In this arrangement, the elongate supports 101 are able to articulate about their centers in order to form a shape which allows for the rack to have opposing sides, with sets of spindles 102 extending outwardly away from each respective side. Here, the articulation is achieved by a hinge 109. The elongate supports 101 obtain a high angle of inclination with respect to the ground, and the sets of spindles 102 commensurately are at a relatively small angle of inclination with respect to vertical. However, because this triangular configuration never arranges the elongate supports 101 in a fully vertical position, the sets of spindles 102 are never parallel to the ground, each extending outwardly in opposite directions, at least some small angle upward.

Figure 7:
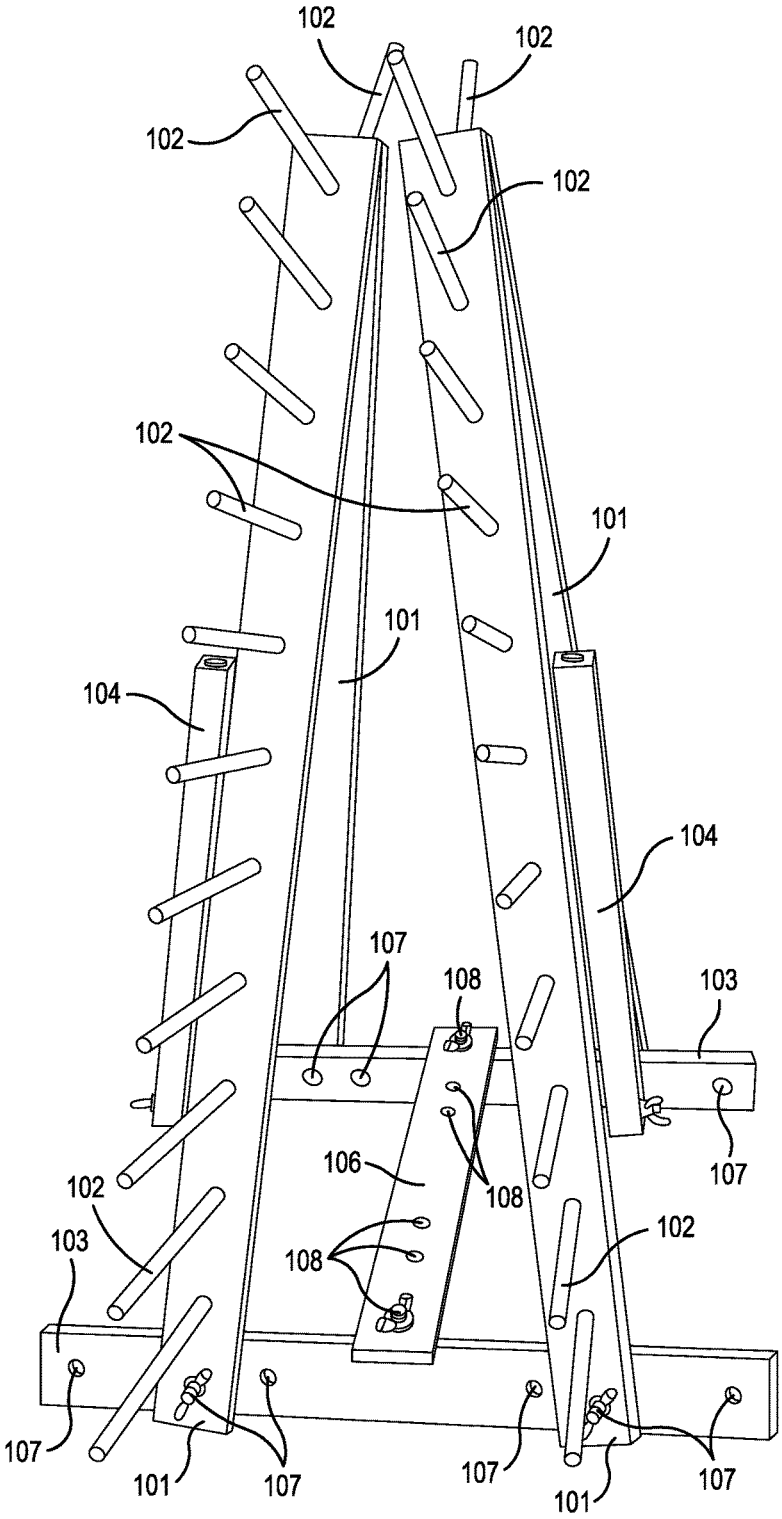
FIG. 7 is a perspective view of the panel drying rack in the triangular configuration with the supports angled towards each other resting on a flat surface.
Figure 8:
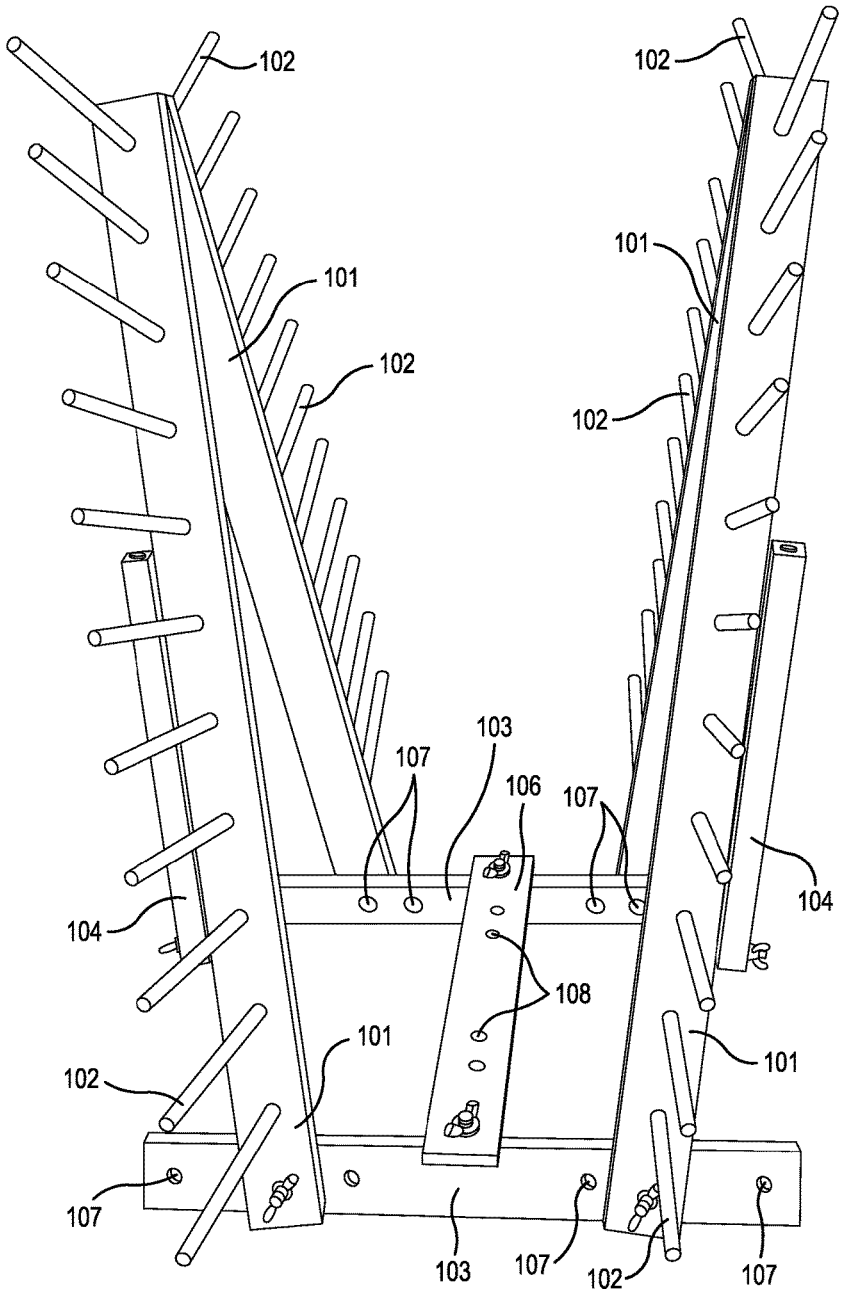
FIG. 8 is a perspective view of the panel drying rack in the triangular configuration with the supports angled away from each other resting on a flat surface.

Referring now to FIGS. 7 and 8, there are shown racks in the triangular configuration that is similar to FIG. 6, but each elongate support 101 is pivotably connected with the spacer bar 103, such that the distance between the elongate supports 101 may be increased or decreased by inclining the elongate supports with respect to one another. In both of FIGS. 7 and 8, the ability of the elongate supports 101 to be located laterally at any of many positions is not impeded by being able to pivot with respect to the spacer bar 103.

In FIG. 7, the elongate supports 101 are inclined toward one another. The distance between the spindles 102 of the set near the top ends of each elongate support 101 is therefore smaller than the spindles 102 of the set at the bottom of the supports 101, such that a smaller painting can be supported. In FIG. 8, the supports 101 are inclined away from one another. The distance between the spindles 102 of the set near the top ends of each elongate support 101 is therefore larger than that of the spindles 102 of the set at the bottom of the supports 101, such that a larger panel can be supported.

Referring back to FIGS. 6-8, the spacer bar 106 extends between the spreader bars 103, to hold them at a lateral distance. The spacer bar 106 comprises several preselected positions at which to engage either spreader bar 106, and thereby maintained the bars at a variety of distances of offset. If the distance of offset is small, the angle of inclination of the elongate supports 101 is high, and brings the angle of inclination of the panel spaces progressively closer to horizontal, which is better for drying. When the distance of offset is large, then the angle of inclination of the elongate supports 101 with respect to the ground is not quite as high, and the panels are at an angle of inclination that is further from horizontal, which affords some greater degree of stability, in terms of retaining panels further into the panel spaces so that they are less likely to be nudged off of a set of spindles 102.

We claim:

1. A system for storing panels, adapted to be supported with respect to a supporting surface, comprising at least one elongate support, the system being adapted to be arranged into plural alternative modes, including modes which orient said at least one elongate support at a non-parallel angle to a supporting surface, further comprising a plurality of spindle sets that are located at intervals along the length of said at least one elongate support, and wherein the spindle sets define panel spaces between adjacent spindle sets, each of said panel spaces being adapted to receive and support panels by defining a panel support plane, the panel support plane arranged at a large angle with respect to the direction of the length of said at least one elongate support, large angle meaning the opposite of a small angle and the same as a high angle of inclination, and further comprising a rail mechanism with a lateral foot, wherein said at least one elongate support is a laterally inconnectable rail with respect to another at least one elongate support, the foot extending in a lateral direction with respect to the length of said at least one elongate support, comprising a range of rail positions along its length, at which said at least one elongate support may be connected at a distance offset from said another at least one elongate support.

2. A panel-supporting apparatus, comprising:

two elongate supports, each support having a length defined by two ends, a plurality of spindles spaced at intervals along the length of each support, wherein a spindle is an elongate member extending substantially perpendicularly with respect to the length of a support, the length of the support meaning the distance between the ends and the direction in which the support extends between the ends, each support comprising a hinge at a central point along its length, and wherein the hinge defines two sides, a side being characterized by extending between an end of the support and the hinge, two spreader bars each having a spreader bar length, a plurality of preselected spreader bar positions along the spreader bar length, the ends being selectably connectable to the spreader bar positions, selectably connectable meaning that the ends are selectable to connect to any of the spreader bar positions in the alternative to the other spreader bar positions, the apparatus further being selectably configurable into plural alternate panel-support modes, comprising at least:

flat to a horizontal surface, meaning the apparatus is placed upon and is supported by a horizontal surface with the supports parallel to the horizontal surface and with the spindles vertical, flat to a vertical surface, meaning the apparatus is placed upon and is supported by a vertical surface with the supports parallel to the vertical surface and with the spindles horizontal, inclined on a horizontal surface, meaning the apparatus is placed upon and is supported by a horizontal surface with the supports distinctly not parallel to the horizontal surface and the spindles distinctly not vertical, inclined on a vertical surface, meaning the apparatus is placed upon and is supported by a vertical surface with the supports distinctly not parallel to the vertical surface and the spindles being distinctly not horizontal, and wherein the apparatus is also not in direct contact with any part of a horizontal surface, and triangular meaning the apparatus is placed upon a supported by a horizontal surface, and stood up into a triangular shape, wherein connecting the ends of the supports to the spreader bars maintains the supports in spaced relation and defines sets of spindles, a set comprising the spindles of each support at each respective interval along the lengths of the supports, and wherein each set at an interval and the set at the immediately successive interval along the lengths thereby defining a panel space, a panel space being a space adapted to receive a panel and support the panel upon the two spindles of either of the sets which defines the panel space.

3. The apparatus of claim 2, and further comprising at least one prop leg, wherein the prop leg is extendable from the apparatus to configure the apparatus into at least two of the alternate modes, comprising the inclined on a horizontal surface mode and the inclined on a vertical surface mode.

4. The apparatus of claim 2, and further comprising a spacer bar with several preselected positions along the length of the spacer bar, wherein the apparatus as configured into the triangular mode is topped with the hinge of each support, the sides of each support extending oppositely from the hinge, downward toward the surface, the sides thereby being opposite sides, the spindles of a side thereby extending in the opposite direction to the spindles of the respectively opposite side, and wherein the spreader bars are laterally spaced from one another with the spacer bar by the spreader bars being alternately connectable to the preselected positions along the length of the spacer bar, such that connecting each spreader bar to the positions defines a distance at which the spreader bars are laterally spaced from one another.

5. The apparatus of claim 4, and further, the sets having a panel-supporting width defined by the distance between the two spindles of each set, and the ends being connectable to the spreader bar positions by being pivotally connectable to the spreader bar positions, such that the supports are pivotable toward one another and pivotable away from one another, wherein pivoting the supports toward one another decreases the panel-supporting width of all of the sets and pivoting the supports away from one another increases the panel-supporting width of all of the sets.

6. The apparatus of claim 4, wherein the preselected positions of the spacer bar comprise at least two positions which are spaced from one another at a distance which corresponds to the distance at which two of the spindles of the apparatus are spaced from one another, such that the spacer bar may be retained upon the two spindles when the apparatus is configured into a mode in which the spacer bar is not in use.

* * * * *